United States Patent [19]

Weldon

[11] Patent Number: 4,551,199

[45] Date of Patent: Nov. 5, 1985

[54] APPARATUS AND PROCESS FOR TREATING WEB MATERIAL

[75] Inventor: Scott B. Weldon, San Mateo, Calif.

[73] Assignee: Crown Zellerbach Corporation, San Francisco, Calif.

[21] Appl. No.: 394,208

[22] Filed: Jul. 1, 1982

[51] Int. Cl.[4] ..... D21H 5/24

[52] U.S. Cl. ..... 162/109; 162/111; 162/113

[58] Field of Search ..... 162/109, 111, 112, 113, 162/117, 280, 281

[56] References Cited

U.S. PATENT DOCUMENTS

| | | | |
|---|---|---|---|
| 790,023 | 5/1905 | Arkell | 162/281 |
| 3,301,746 | 1/1967 | Sanford et al. | 162/113 |
| 4,072,557 | 2/1978 | Schiel | 162/111 |
| 4,309,246 | 1/1982 | Hulit et al. | 162/113 |

FOREIGN PATENT DOCUMENTS

| | | | |
|---|---|---|---|
| 1212473 | 11/1970 | United Kingdom | 162/109 |

*Primary Examiner*—Peter Chin

*Attorney, Agent, or Firm*—Thomas R. Lampe

[57] ABSTRACT

A system of treating web material wherein the web is transported within a differential relative velocity nip defined by a web support surface and a pick-up member having voids therein and having a relative velocity differing from that of the support surface at the nip location. Substantially simultaneously with the web treatment the web is applied to the pick-up member with the web impressed into the voids to lock the web against movement relative to the pick-up member.

14 Claims, 5 Drawing Figures

APPARATUS AND PROCESS FOR TREATING WEB MATERIAL

BACKGROUND OF THE INVENTION

1. Field of Invention

This invention relates to a system for treating web material such as paper sheets, and in particular, to a system that substantially simultaneously bulks, crepes, embosses and provides extensibility thereto and locks said characteristics into the web material.

2. Description of the Prior Art

A number of systems have been employed in the past for bulking, creping and embossing paper webs and similar web material to attain desirable characteristics in the end product such as extensibility, greater absorbency and strength and higher bulk. Such prior art approaches are generally characterized by their complexity and high expense and the process steps are often carried out sequentially through the use of separate equipment between which the web must be conveyed across open draws. Open draws lead to web control problems which may place unnecessary speed limitations on the production equipment to avoid web breakage or other undesirable consequences. It is often desirable to perform such treatment on paper webs still sufficiently wet so that the cellulosic fibers thereof have not yet been completely bonded together or set and the problem of potential web breakage becomes even more acute. Also, when conveying a web in moist condition between the various operating stages there is always some loss of the characteristics imparted to the web at the previous stage or stages. For example, in a wet web loss of crepe is frequently encountered after the wet creping stage because of the weakness thereof, particularly when the sheet is passed through an open draw as is often the case in conventional wet creping operations.

BRIEF SUMMARY OF THE INVENTION

According to the teachings of the present invention a web is bulked, creped and embossed in a single operation under conditions of continuous web support and control. In addition, the desired characteristics imparted to the web by such treatment are "locked" into the web as the operation is carried out.

According to the present invention web material such as a paper web is transported on a transport surface through a differential relative velocity nip defined by the transport surface and the surface of a pick-up member having a relative velocity differing from that of the transport surface at the nip location. The pick-up member includes web locking elements defining voids and selected portions of the web are impressed into the voids during web passage between the pick-up member and the transport surface. The differential relative velocity nip results in the simultaneous bulking, creping, and embossment of the web as well as transfer of the web to the pick-up member. Due to the fact that the web is impressed into the voids of the pick-up member the web will be mechanically locked into position thereon by the locking elements and will retain the desired characteristics just imparted to it. In the preferred embodiment the pick-up member is an open mesh fabric woven or otherwise formed by filaments with the filaments comprising the locking elements and the voids being defined by the filaments. The filaments may be made from a single strand of material (monofilament) or comprised of a plurality of strands (multifilament). The fabric can be readily replaced and adjusted as necessary.

DETAILED DESCRIPTION

Figure 1:
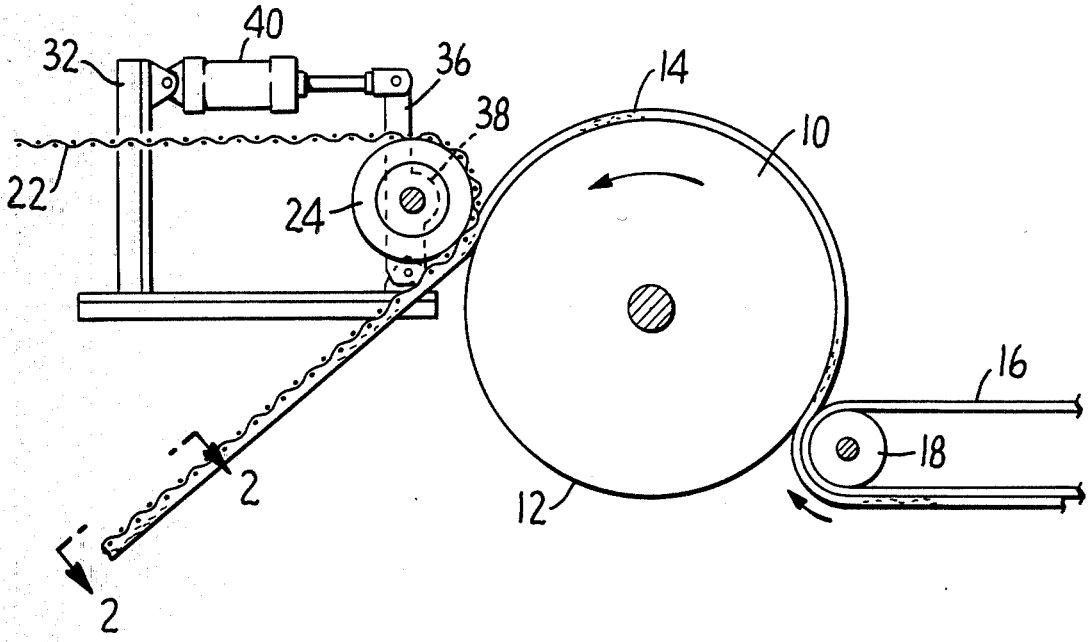
FIG. 1 is a schematic side view of one form of apparatus constructed in accordance with the teachings of the present invention and for carrying out the method thereof.

Referring now to FIG. 1, a preferred form of apparatus constructed in accordance with the teachings of the present invention is illustrated. For purposes of illustration, the web to be treated is a paper web. The apparatus includes a transport member 10 which in the disclosed embodiment comprises a Yankee dryer having an outer support surface 12 for supporting and transporting a web 14. It will be appreciated that a cylinder, belt or other member having a suitable web support surface may be substituted for the Yankee. The web is formed by any suitable conventional web forming equipment (not shown) such as a Fourdrinier machine, twin wire former, dry former, etc. and delivered and applied to the support surface 12 by any suitable expedient such as carrier felt 16 disposed about roll 18.

Figure 2:
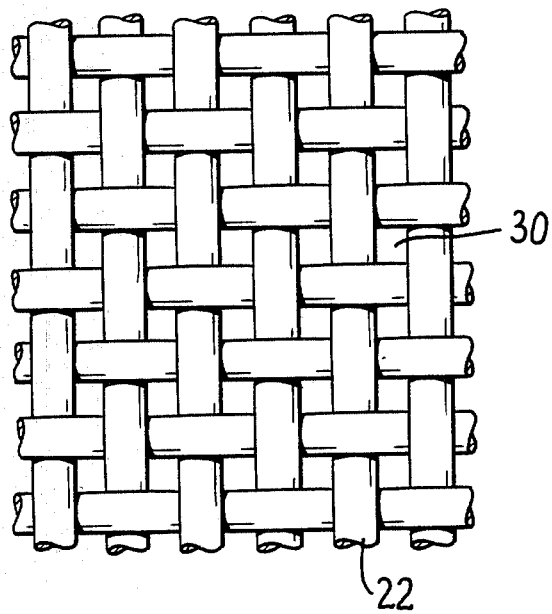
FIG. 2 is an enlarged plan view of an open mesh fabric suitable for use in connection with the present invention.
Figure 3:
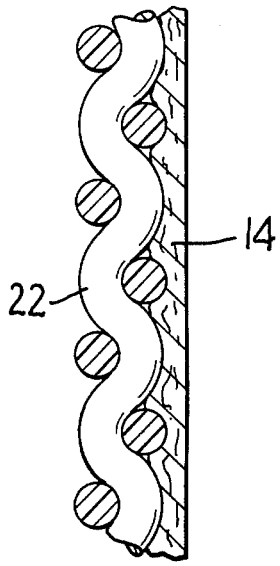
FIG. 3 is an enlarged side view of the fabric of FIG. 2 with a paper web impressed thereon.
Figure 5:
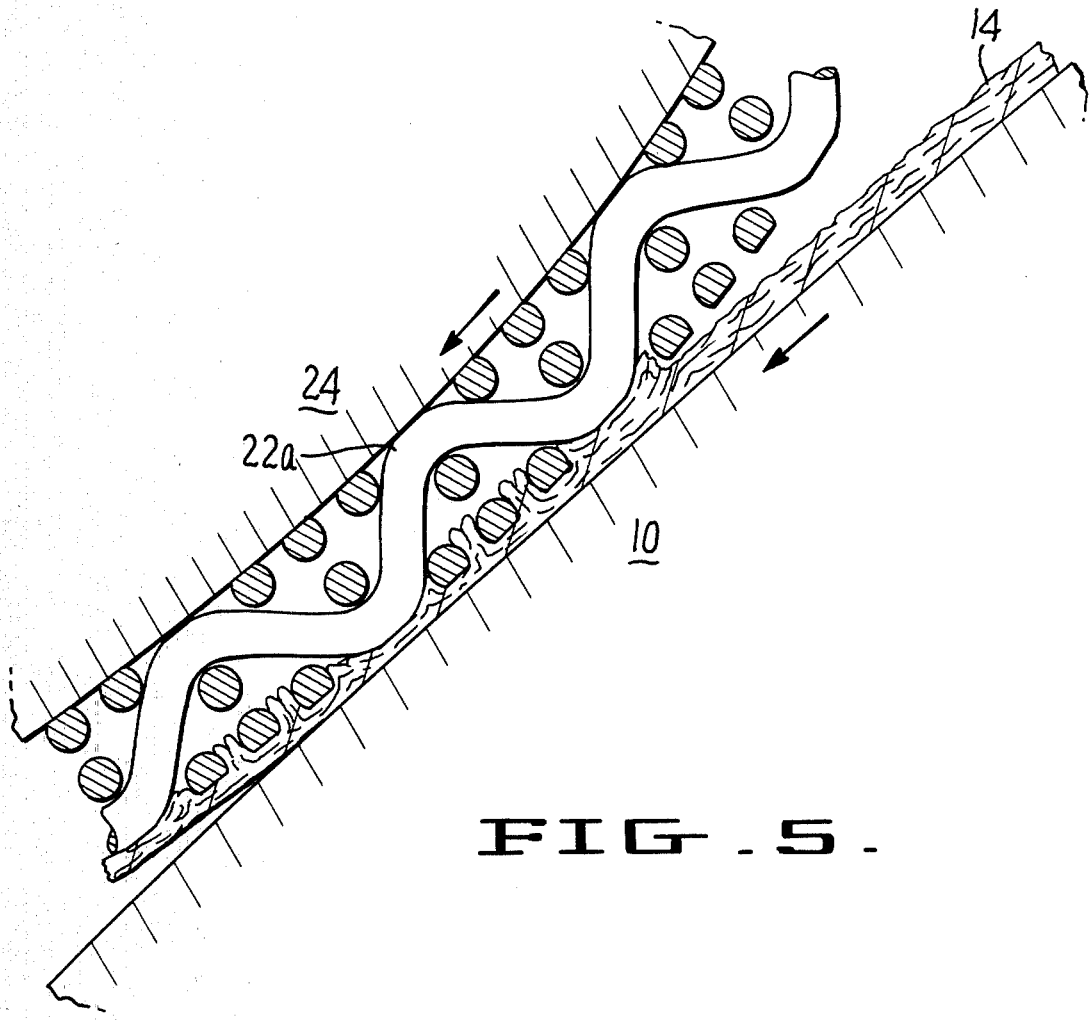
FIG. 5 is an enlarged cross sectional side view showing passage of an alternate form of fabric and a web between a transport surface and back-up roll.

Transport member 10 is rotated counter clockwise as viewed in FIG. 1 so that the support surface thereof moves at a predetermined speed. The web is delivered to a nip formed between the support surface 12 and the outer surface of a pick-up member 22 disposed about a back-up device such as back-up or press roll 24 which may, if desired, be a vacuum roll. Alternatively, a shoe may be employed as the back-up device. Pick-up member 22 is preferably in the form of a continuous loop (only the pertinent portion of which is illustrated) and preferably comprises an open mesh fabric formed of woven filaments and defining voids between the filaments. As will be seen, the filaments function as web locking elements which serve to lock and retain the web therein in creped, bulked and embossed condition. The structure of a representative open mesh fabric is shown in detail in FIGS. 2 and 3 wherein it may be seen that fabric 22 comprises warp and woof filaments defining voids 30 therebetween. Pick-up member 22 is driven in a clockwise manner as viewed in FIG. 1 through any suitable mechanism. The pick-up member is driven so that the outer surface thereof has a surface speed less than the surface speed of the transport member support surface 12. This differential relative velocity nip arrangement results in the accumulation and bulking of the web at the nip location as well as the creping thereof. Also, substantially simultaneously with occurrence of the aforesaid treatment the web is impressed into the voids 30 of the open mesh fabric 22 with the filaments embossing the web. This action is illustrated in FIG. 5 where the accumulation of the web and extrusion of portions thereof into the voids of an open mesh fabric are illustrated. In this particular figure an alternative form of fabric 22a, a double layer fabric, is illustrated and it will be understood that the principles of the present invention are not to be restricted to any particular type of pick-up member or fabric of any particular type as long as it has sufficient voids, locking elements, and other characteristics enabling it to attain the desired objectives of this invention.

Insofar as the theory of operation of the present invention is concerned, as the web approaches the point of convergence between the fabric and support surface of the Yankee dryer or other support member a deceleration of the web occurs. This is caused by the impact of the web against the slower moving fabric filaments. On impact, the pick-up web collapses on itself one or more times to form crepe folds. The succeeding folds in the web press against the earlier folds, pushing them into the voids of the fabric, the size and number of folds being determined among other things by the flexibility of the web and the magnitude of the relative velocity differential between the fabric and the support surface of transport member 10.

Because the web is impressed into the voids the web will be locked into position by the filaments which function as locking elements and be retained on the open mesh fabric as such member diverges from the support surface 12. Thus, the web will be locked into position by the locking elements and retained on the pick-up member with the crepe folds, embossments (formed by the filaments) and other desirable features of the web being maintained. The web will then be conveyed by pick-up member 22 to a downstream station for subsequent additional drying or other desired treatment before removal therefrom.

When a back-up roll such as roll 24 is employed it is desirable to provide some means whereby it may be readily adjusted relative to transport member 10. FIG. 1 illustrates a simple adjustment arrangement. Specifically a framework 32 of structural steel or the like is provided. Pivotally connected to framework 32 as by means of a connector pin are roll support arms 36 (only one of which is shown) having centrally disposed bearings 38 which freely rotatably accomodate the shaft ends of back-up roll 24. One or more hydraulic or air cylinders 40 are employed to selectively pivot roll support arms 36 and hence adjust the position of back-up roll 24 relative to transport member 10. In the arrangement of FIG. 1 the back-up roll 24 preferably has a resilient outer cover formed of rubber or the like which will serve to distribute forces evenly across the full width of pick-up member 22 and accomodate any dimensional variations therein.

Figure 4:
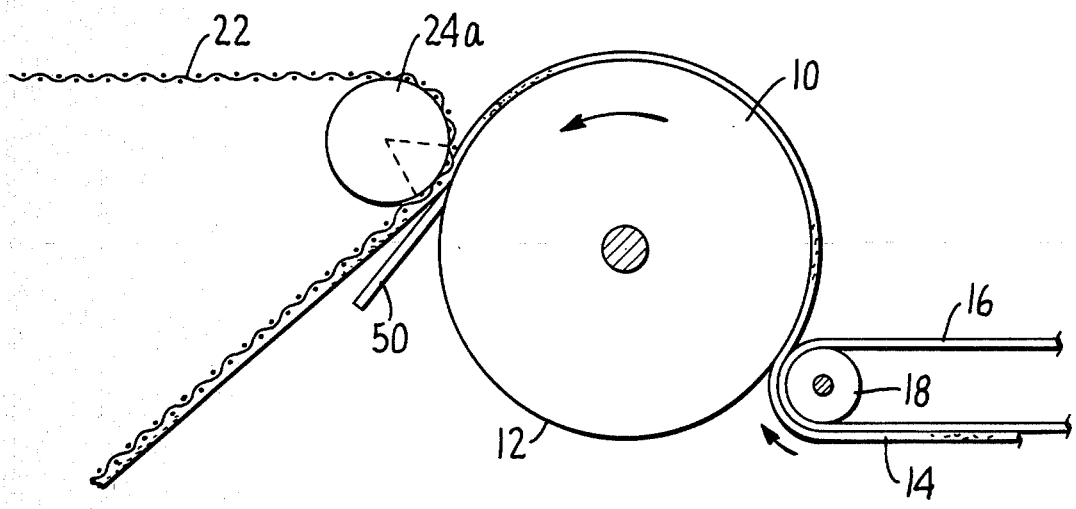
FIG. 4 is a view similar to FIG. 1 but showing an alternate form of apparatus.

FIG. 4 illustrates an alternative embodiment of the present invention. Whereas the embodiment of FIG. 1 relies solely on pressure between pick-up member 22 and the faster transport member support surface 12 to treat the web and adhere it to the pick-up member, in the arrangement of FIG. 4 supplemental means for accomplishing this end is provided. Specifically, a doctor blade 50 is positioned in engagement with transport surface 12 with the working edge thereof positioned in the nip formed between back-up roll 24a and the support surface. This arrangement is particularly useful when a gap is maintained between the pick-up member 22 and support surface 12 and compression of the web by these elements alone might not be sufficient to effect transfer of the wet web to the pick-up member. In addition to at least partially assisting in making such transfer the doctor blade 50 contributes to the creping and bulking of the web by interrupting movement of the web. The arrangement of FIG. 4 also differs from that of FIG. 1 by virtue of the fact that the back-up device employed is a hard vacuum roll 24a with the vacuum being applied to the backside of pick-up member 22 to assist in movement of the web into the voids thereof whereat the filament locking elements lock the web for retention on the pick-up member after the vacuum section is passed.

It will be appreciated that the operating parameters of the present invention will depend upon many factors such as the basis weight and other physical characteristics of the web, the moisture content thereof, the differential relative velocity between the pick-up member and transport member, nip loading pressures and the natures of the pick-up members and back-up devices employed. To illustrate the present invention, experiments were conducted employing the general arrangement of FIG. 1. A furnish of 100% bleached kraft hemlock pulp was used without refining or additives to provide flat sheets that varied from 9 to 28 lbs/3000 sq.ft. At each weight, the differential speed, web dryness and nip loading were varied. Samples of the creped papers were obtained by stopping the fabric and air-drying the sheet on the fabric. These dried sheets were removed and submitted for analysis. Successful creping occurred within the following range of machine conditions:

| Variable | Units | Operating Range |
|---|---|---|
| Basis Weight | lbs/3000 sq. ft. | 9 to 28 |
| Web Dryness | % o.d. | 37 to 62 |
| Differential Fabric Speed | % | 13 to 51 |
| Nip Loading | pli | 40 to 75 |

The dried sheets were tested for basis weight and Lobb caliper (thickness when loaded to 1.35 lb/in$^2$) and values for Lobb density were calculated. At a given weight the densities are consistently less than would be expected for a conventionally wet-creped sheet:

| Basis Weight lbs/3000 sq. ft. | Lobb Bulk mils/24 sheets | Lobb Density grams/cc |
|---|---|---|
| 10.1 | 116 | 0.133 |
| 12.3 | 159 | 0.119 |
| 13.8 | 144 | 0.147 |
| 18.5 | 200 | 0.142 |
| 24.2 | 274 | 0.136 |
| 25.6 | 296 | 0.133 |
| 26.5 | 295 | 0.138 |
| 33.6 | 282 | 0.183 |
| 38.8 | 300 | 0.199 |
| 41.7 | 295 | 0.217 |

During the planning phase of these runs, it was believed that a fixed clearance between the fabric surface and the Yankee would be necessary. For this reason stops were installed against which the air cylinders 40 were loaded. In early experiments this gap was adjusted to 0.002 to 0.004 in. It was later discovered that a more positive transfer occurred by loading directly against the paper with adjustments in the air pressure to the cylinders.

The influence of fabric design was evaluated by comparing both sides of a double-layer Style 850 monofilament fabric made available by The Albany Felt Company, the warp and woof characteristics of which are shown in FIG. 5. One side of this fabric was sanded to increase its surface area. The other side remained unsanded. In the experiments the sanded surface permitted easier tranfer and creping. However, the non-sanded side could be made to work successfully by selecting a higher nip loading (75 vs. 40 pli).

As previously stated, the present invention encompasses the transporting of a paper web on a transport surface through a differential relative velocity nip defined by the transport surface and the surface of a pick-up member having a relative velocity differing from that of the transport surface. As described above, this differential relative velocity nip was defined by a pick-up member and a support surface moving in the same direction but at different speeds at the nip location. That is, the faster moving web on the transport surface impacted on either a slower moving pick-up member directly or against a creping blade operatively associated with a slower moving pick-up member to effect substantially simultaneous bulking, creping, embossment and transfer of the web. Rather than operating the apparatus in this manner it is considered within the scope of the present invention to run the pick-up member in a direction opposite to the direction of motion of the transport surface at the nip location to define the differential relative velocity nip. In other words, substantially simultaneously with the crepe and transfer functions the web would be subjected to an essentially 180 degree reversal in direction of movement. With this latter approach a differential relative velocity nip would be created even if the pick-up member and transport surface were driven at the same speeds.

While the present invention is believed to have particular benefit when utilized with a wet web wherein the cellulosic fibers have not yet completely bonded together or set, the advantage of maintaining complete web control is equally applicable when utilizing the teachings thereof to treat a dryer web.

As stated above, any form of pick-up member may be employed when practicing this invention as long as it has sufficient voids, locking elements, and other characteristics enabling it to attain the desired objectives of this invention. For example, it is possible that the pick-up member, rather than comprising a fabric, may be in the form of a rotating roll or drum suitably machined or otherwise forming on the outer periphery thereof voids into which the web is impressed and locking elements for retaining the web thereon. A fabric, however, is considered to be the preferred form of pick-up member since such an element can be readily employed as a continuous support for the web as it proceeds through one or more additional stages of the manufacturing process such as a through dryer stage. Also, such fabric may to be used as an imprinting fabric to directly apply the web to a Yankee dryer or other dryer device as taught, for example, in U.S. Pat. No. 4,309,246 issued to Hulit, et al. on Jan. 5, 1982. It will be appreciated that the web may be subjected to any desirable treatment after passing through the differential velocity nip. For example, the web may be subjected to supplemental pressing by a press roll and/or supplemental vacuum box treatment downstream from the nip.

I claim:

1. A process of treating fibrous web material comprising the steps of:

applying said web to the outer, cylindrically-shaped generally smooth transport surface of a rotating member at a predetermined first location;

positioning an open mesh fabric pick-up member including web locking fabric filaments defining voids at a predetermined second location whereat a surface of said open mesh fabric pick-up member is closely adjacent to said transport surface;

transporting said web on said transport surface between said first and second locations at a predetermined transport surface speed;

driving said open mesh fabric pick-up member so that it has a relative velocity differing from that of said transport surface whereby a differential relative velocity nip is defined thereby at said predetermined second location;

passing said web between said open mesh fabric pick-up member and said transport surface through said differential relative velocity nip;

at said nip, bringing said web into engagement with said fabric filaments;

decelerating said web and moving said web on and relative to said generally smooth transport surface with said fabric filaments thereby causing said web to accumulate and bulk at said nip;

transferring said accumulated and bulked web to said open mesh fabric pick-up member substantially simultaneously with passage of said web between the open mesh fabric pick-up member and transport surface by pressing said transport surface against said web and impressing a portion of said web into said voids;

retaining said web on said open mesh fabric pick-up member in locking engagement with said fabric filaments after the web has passed between the open mesh fabric pick-up member and transport surface; and transporting said bulked web on said open mesh fabric pick-up member away from said transport surface with the web in locking engagement with said fabric filaments.

2. The process of claim 1 wherein said transport surface is the outer surface of a rotating cylinder and wherein the web is doctored from the cylinder at said predetermined second location.

3. The process of claim 1 wherein a vacuum is applied to the open mesh fabric pick-up member through said fabric filaments to supplement said impressing step and draw the web into engagement with said filaments whereby said web portions are positioned in said voids.

4. The process of claim 1 including the step of forming crepe folds in said web during transfer of the web to the pick-up member.

5. The process of claim 1 wherein said pick-up member is driven at a predetermined surface speed less than the predetermined speed of said transport surface.

6. The process of claim 5 wherein said pick-up member and transport surface are moving in the same direction at the location of said nip.

7. The process of claim 1 wherein said pick-up member and transport surface move in opposite directions at the location of said nip whereby the web is subjected to a substantially 180 degree change of direction during transfer.

8. A process of treating fibrous web material comprising the steps of:

transporting said web along a predetermined path of movement on a generally smooth transport surface of a cylindrically-shaped transport member having a predetermined surface speed, said predetermined path of movement leading to a differential relative velocity nip formed between said transport member surface and a surface of a moving open mesh fabric pick-up member including web locking elements in the form of fabric filaments defining voids therebetween;

during said web transport through said differential relative velocity nip, forming crepe folds in said web by bringing said fabric filaments and said web into engagement and employing said fabric filaments to decelerate said web to move said web on and relative to said generally smooth transport surface;

transferring said creped web to said pick-up member substantially simultaneously with the step of forming said crepe folds; and at said nip, pressing said generally smooth transport surface against said web to impress portions of the web into locking engagement with said fabric filaments and into the voids of the open mesh fabric pick-up member substantially simultaneously with said transfer and crepe forming steps to form embossments in said web and to lock the web against movement relative to the open mesh fabric pick-up member so that the crepe folds and embossments are retained therein.

9. The process of claim 8 wherein the web is doctored from the generally smooth transport surface toward said open mesh fabric pick-up member at said nip location.

10. The process of claim 8 wherein said web is continuously supported during transfer thereof to said pick-up member.

11. The process of claim 8 wherein said differential relative velocity nip is defined by said transport member surface moving at a predetermined speed and the pick-up member moving at a lesser speed through the nip than the transport member surface predetermined speed.

12. The process of claim 11 wherein the pick-up member and transport member surface are moving in the same direction at the nip.

13. The process of claim 8 wherein the transport member surface and pick-up member move in opposite directions at the nip.

14. The process of claim 8 including the step of heating said web on said transport surface.

* * * * *